US008708479B2

(12) United States Patent
Link

(10) Patent No.: US 8,708,479 B2
(45) Date of Patent: Apr. 29, 2014

(54) METHOD TO REDUCE THE CURLING OF A PRINTING SUBSTRATE IN A PRINTER, AND DEVICE TO PRINT TO A PRINTING SUBSTRATE

(75) Inventor: Robert Link, Munich (DE)

(73) Assignee: Oce Printing Systems GmbH, Poing (DE)

( * ) Notice: Subject to any disclaimer, the term of this patent is extended or adjusted under 35 U.S.C. 154(b) by 136 days.

(21) Appl. No.: 13/291,768

(22) Filed: Nov. 8, 2011

(65) Prior Publication Data

US 2012/0113205 A1 May 10, 2012

(30) Foreign Application Priority Data

Nov. 8, 2010 (DE) ..... 10 2010 060 409

(51) Int. Cl.
*B41J 2/01* (2006.01)

(52) U.S. Cl.
USPC ..... 347/104; 347/95

(58) Field of Classification Search
USPC ..... 347/101, 104, 40, 41, 42, 43, 95, 96, 347/100
See application file for complete search history.

(56) References Cited

U.S. PATENT DOCUMENTS

| | | | | |
|---|---|---|---|---|
| 5,764,263 | A | 6/1998 | Lin | |
| 2009/0256896 | A1 * | 10/2009 | Scarlata | 347/101 |
| 2010/0231673 | A1 | 9/2010 | Chiwata | |

FOREIGN PATENT DOCUMENTS

| | | | | |
|---|---|---|---|---|
| DE | 69700413 | T2 | 8/1999 | |
| EP | 0787596 | B1 | 8/1999 | |
| GB | 2353761 | A | 7/2001 | |
| JP | 2005-212371 | A * | 11/2005 | B41M 5/00 |

* cited by examiner

*Primary Examiner* — Manish S Shah
*Assistant Examiner* — Yaovi Ameh
(74) *Attorney, Agent, or Firm* — Schiff Hardin LLP

(57) ABSTRACT

In a method or device to reduce curling of a printing substrate in a printer, at least one print region of the printing substrate is printed with ink. A moisture level of the printing substrate is increased in at least one unprinted partial region of the printing substrate that is arranged on a same side of the printing substrate as the print region.

7 Claims, 5 Drawing Sheets

METHOD TO REDUCE THE CURLING OF A PRINTING SUBSTRATE IN A PRINTER, AND DEVICE TO PRINT TO A PRINTING SUBSTRATE

BACKGROUND

The preferred embodiment concerns a method to reduce the curling of a printing substrate in a printer, in which at least one print region of the printing substrate is printed with ink. The preferred embodiment also concerns a device to print to a printing substrate with ink.

Moisture is introduced into the printing substrate via the application of the ink, such that moisture differences occur within the printing substrate. The more ink that is applied, the damper the printing substrate in this region. Furthermore, the moisture of the printing substrate depends on the material of the printing substrate, in particular the absorption capability of the material. In particular, paper is used as a printing substrate. The introduction of the moisture leads to a swelling of the fibers of the printing substrate in this region, such that tension differences in the printing substrate that lead to the formation of waves (what is known as "curling") arise due to the moisture differences of the printing substrate. The quality of the print image is affected by the curling, and the travel behavior of the printing substrate web in the printer and in additional processing devices arranged after the printer is negatively affected. The swelled printing substrate also incites a poorer optical impression than a smooth printing substrate.

A known method to reduce the curling is to direct the printing substrate around rollers with relatively large radii, and to thus pull the waves out of the printing substrate. What is disadvantageous in this method is that it can hereby lead to folding. In order to avoid or to minimize this, rollers with large radius must be used, and the printing substrate must be directed so that it is advantageously deflected by angles less than 45°. This in turn has the consequence that a great deal of structural space is required, and the printer has a complex and costly design.

Inkjet recording methods in which a print image is applied with water-based ink on one side of the printing substrate are known from the documents EP 0 787 596 B1 and U.S. Pat. No. 5,764,263. The water-based ink also comprises a humectant and/or a curling preventative. On the opposite side, at the points at which the print image was applied, the same print image is applied with a clear fluid that comprises the same humectant and/or the same curling preventative. In the method it is problematic that the print image must be applied on both sides, and that special substances must respectively be added to the ink or clear fluid.

SUMMARY

It is an object to specify a method to reduce the curling of a printing substrate in a printer and a device to print to a printing substrate, in which method the curling of the printing substrate is reduced in a simple manner.

In a method or device to reduce curling of a printing substrate in a printer, at least one print region of the printing substrate is printed with ink. A moisture level of the printing substrate is increased in at least one unprinted partial region of the printing substrate that is arranged on a same side of the printing substrate as the print region.

DESCRIPTION OF THE PREFERRED EMBODIMENTS

Figure 1:
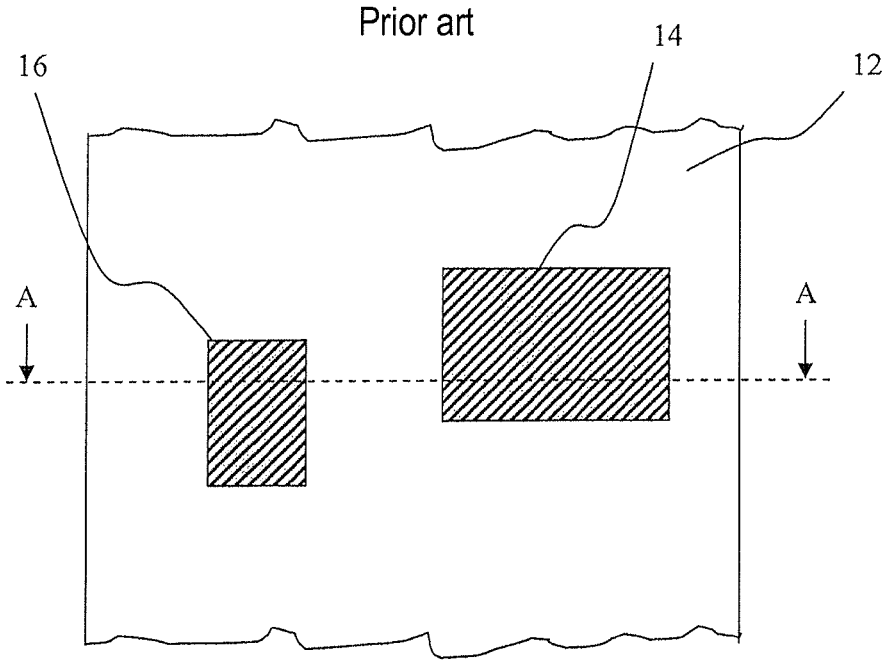
FIG. 1 is an excerpt of a printing substrate web printed according to a method according to the prior art.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included.

By increasing the moisture of the printing substrate in at least one unprinted partial region of the printing substrate, it is achieved that the moisture difference between the print region and the unprinted partial region is reduced. Tension differences in the printing substrate can hereby also be reduced, such that the curling is prevented or at least reduced. It is thus unnecessary to direct the printing substrate over elements that are specially provided for this in order to prevent or compensate the curling. A simpler, space-saving, cost-effective design of the printer is hereby achieved.

The printing substrate is in particular paper. In one preferred exemplary embodiment, a paper web is transported and printed in a transport direction. Alternatively, sheet-shaped recording media—in particular sheets of paper—can also be printed.

The moisture of the printing substrate in the at least one unprinted partial region is in particular increased by applying a transparent fluid. It is hereby achieved that the moisture can be locally applied in the unprinted partial region and can be dosed precisely, such that the moisture difference at the print region is corrected or at least reduced. The transparent fluid is in particular water, such that a cost-effective method is achieved. Alternatively, transparent ink and/or a cleaning fluid can also be applied to increase the moisture of the printing substrate at the at least one partial region.

In one preferred exemplary embodiment, not only an unprinted partial region of the printing substrate but the entire unprinted region of the printing substrate is moistened, such that the entire printing substrate has approximately the same moisture level. The curling is thus avoided over the entire printing substrate.

The print image is not altered by the application of the transparent fluid. The transparent fluid in particular does not contain any dye.

In one preferred exemplary embodiment, a preset quantity of fluid is applied, wherein this quantity is preset such that, after the application of the fluid, the printing substrate has approximately the same relative moisture in the print region and in the unprinted partial region at which the fluid is applied. The moisture differences are thus reduced and a curling is avoided.

The ink and the fluid are in particular applied on the same side of the printing substrate. The fluid is in particular applied with the aid of the at least one print head. By applying the ink and the fluid on the same side, it is achieved that print heads—namely at least one print head to apply the ink and at least one print head to apply the fluid—must be provided only on one side of the printing substrate, such that a simpler, space-saving design is possible.

In particular, a print image is applied on the printing substrate with the aid of the ink, wherein ink is applied to the image regions of the print image. The fluid is applied to the non-image regions. It is thus achieved that those partial regions that were not printed with ink are printed with the fluid, such that the moisture level in the unprinted regions is raised. In a particularly preferred exemplary embodiment, fluid is also applied in those partial regions of the print image in which ink was applied, but less ink than in other partial regions of the print region, such that moisture differences of the printing substrate are also compensated within the print region.

The fluid can also be applied in an additional non-printing partial region that likewise adjoins the partial region, wherein the quantity of fluid applied per areal unit is less in the additional partial region than in the one partial region. It is herewith achieved that no abrupt transition is present between a region with high moisture and a region with a low moisture; rather, the moisture difference takes place in stages, in multiple smaller steps. In particular, a continuous transition is formed between the region with a high moisture level (thus the printed region and the region at which fluid was applied in large quantity) and that region in which neither ink nor fluid is applied. The curling is avoided in this manner.

In an alternative exemplary embodiment of the invention, the printing substrate can be transported through a humidifier space in which the absolute humidity is greater than in the region of the printer in which the ink is applied onto the printing substrate. In this way the moisture compensation in the printing substrate is assisted based on vapor pressure differences. In the humidifier space, the vapor pressure difference between the printing substrate and the environment air is greater than in the region in which ink is imprinted, such that the moisture compensation takes place more quickly. In this embodiment the application of fluid onto the unprinted regions can be omitted. The moisture compensation takes place due to the vapor pressure difference and is accelerated due to the increase of the vapor pressure difference.

An additional aspect of the exemplary embodiment of the invention concerns a device for printing a printing substrate with ink, which device comprises at least one print head that prints to the at least one print region of the printing substrate with the ink. The device also has a moistening unit to increase the moisture level of the printing substrate in at least one unprinted partial region of the printing substrate. It is hereby achieved that the moisture level in the unprinted partial region is increased, and thus the moisture difference between the unprinted region and the printed region is reduced so that curling is avoided, or at least reduced.

In a preferred exemplary embodiment, the moisture unit comprises at least one additional print head to apply a fluid onto the at least one unprinted partial region. In this way the fluid can be applied and dosed with higher precision. In particular, a print head that has fewer nozzles per areal unit than the print head with which the ink is applied is used to apply the fluid. A simpler, more cost-effective design is thus achieved.

The application of the fluid in particular takes place after the printing of the printing substrate with ink. In a particularly preferred exemplary embodiment of the invention, the application of the fluid takes place immediately after the printing with ink so that the moisture differences are compensated quickly and the curling is avoided from the outset.

The printer in particular comprises a drying unit to dry the printing substrate. In this case the fluid can also only be applied after the drying of the printing substrate in order to have to remove as little moisture as possible from the printing substrate in the drying, and thus to keep the energy requirement as small as possible.

Some exemplary embodiments are shown in the drawing figures.

An excerpt of a printing substrate web 12 that was printed with ink (in particular water-based ink) with a method known from the prior art is shown in FIG. 1. The ink was hereby printed onto the printing substrate web 12 in the two print regions 14, 16 via print heads. The water of the ink hereby penetrates at least partially into the printing substrate so that the printing substrate web has a higher moisture content in the print region 14, 16 than in the unprinted regions of the printing substrate web 12. In the print regions 14, 16 the relative moisture then amounts to between 70% and 100%, in contrast to which the relative moisture only amounts to between 30% and 40% in the unprinted regions.

Figure 2:
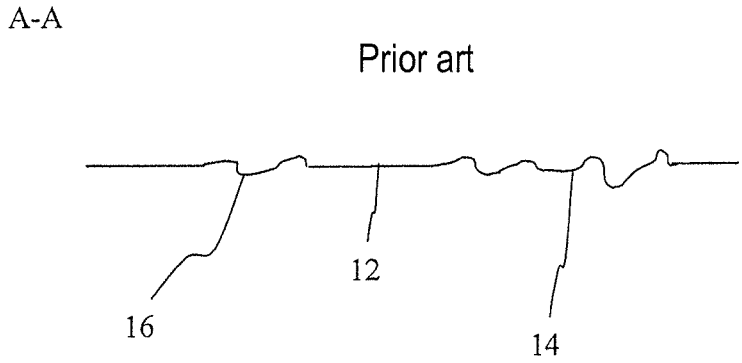
FIG. 2 is a section presentation through the printing substrate web according to FIG. 1, along the section A-A.

Tension differences occur in the printing substrate due to the moisture differences within said printing substrate, which leads to a curling of the printing substrate web 12 as shown in the section presentation in FIG. 2. The printing substrate web curls in the print regions 14, 16, in contrast to which it remains approximately smooth in the unprinted regions arranged between the print regions 14, 16.

Figure 3:
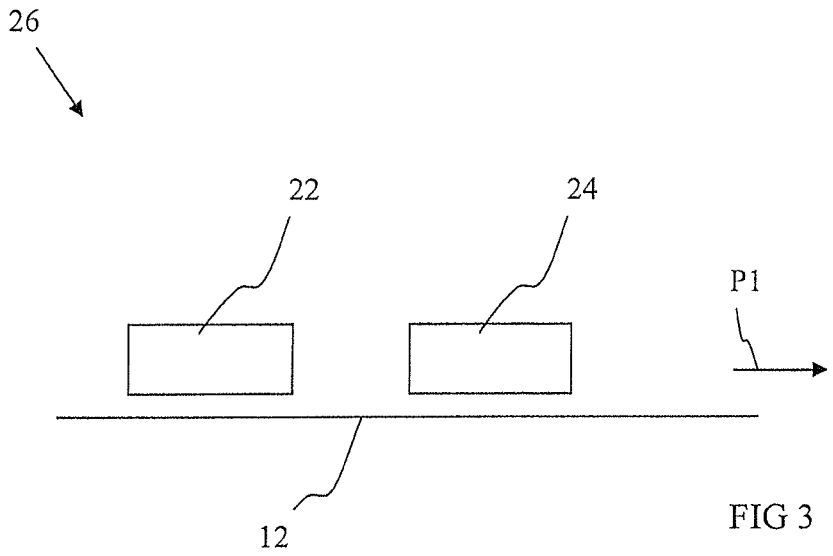
FIG. 3 is a schematic presentation of a device for printing a printing substrate web according to a first exemplary embodiment.

A schematic presentation of a device 26 to print to the printing substrate web 12 with ink (in particular water-based ink) is shown in FIG. 3. The printing substrate web 12 is transported in the direction of the arrow P1. The printing substrate web 12 is in particular a paper web. In an alternative exemplary embodiment of the invention, page-shaped or sheet-shaped recording material (in particular paper pages) can also be printed instead of web-shaped printing substrate webs 12.

The device 26 comprises at least one first print head 22 via which the ink is applied onto the printing substrate web 12 according to a print image. Multiple print regions 14, 16 of the printing substrate web 12 are hereby printed with ink according to the desired print image, in contrast to which other regions are not printed. The device 26 also comprises a moistening unit 24 that that is arranged after the print head 22 (as viewed in the transport direction P1 of the printing substrate web 12). The moistening unit 24 comprises at least one print head via which a transparent fluid (in particular a transparent, water-based fluid) can be applied to the printing substrate web 12.

Figure 4:
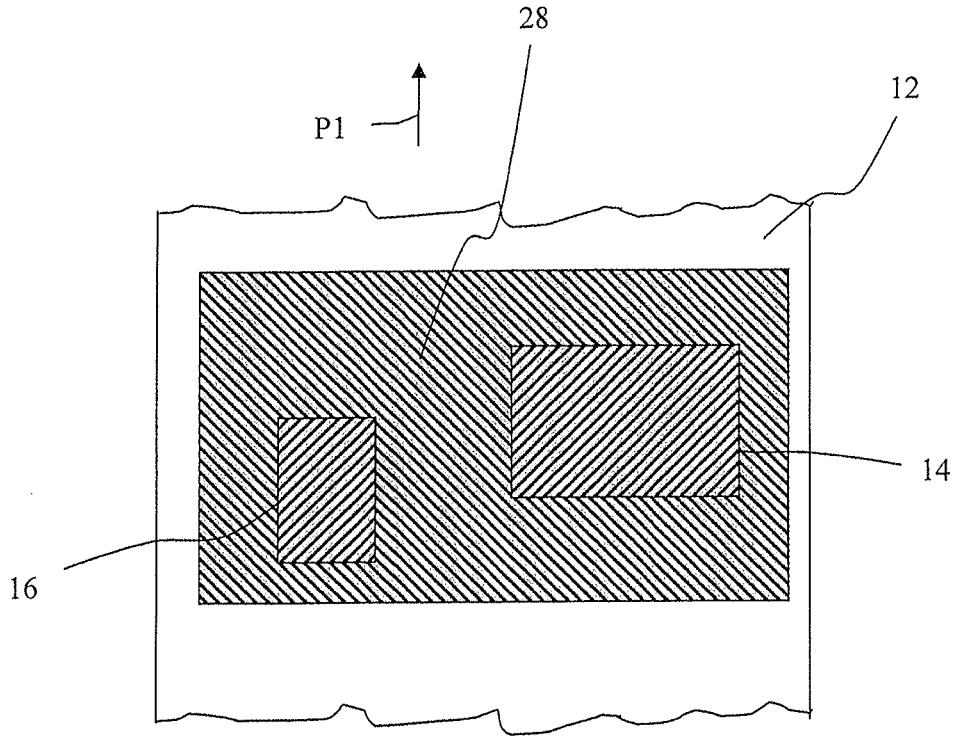
FIG. 4 is a schematic presentation of an excerpt with a printing substrate web printed with the device according to FIG. 3.

An excerpt of the printing substrate web 12 is shown in FIG. 4 after this has been printed with the aid of the device 26. The ink was applied in the print regions 14, 16 according to the print image with the aid of the print head 22. With the aid of the moistening unit 24, the fluid was subsequently applied in an unprinted partial region 28 of the printing substrate 12 that surrounds the print regions 14, 16. It is hereby achieved that the moisture of the printing substrate web 12 is increased in the partial region 28, such that the difference of the moisture content between the print regions 14, 16 and the unprinted partial region 28 is reduced. The curling is hereby again prevented or at least reduced.

Water is advantageously used as a transparent fluid. Alternatively, a cleaning fluid and/or transparent ink can also be used. The print head of the moistening unit 24 in particular has fewer nozzles per areal unit than the print head 22 for application of the ink. A simpler and more cost-effective design is hereby achieved. The quantity of fluid that is applied via the moistening unit 24 in the unprinted partial region 28 is in particular preset such that the printing substrate web 12 has approximately the same relative moisture in the print regions 14, 16 and in the unprinted partial region 28 after the application of the fluid.

In a preferred exemplary embodiment, the image regions of the print image are printed with ink and the non-image regions are printed with fluid. It is thus achieved that all unprinted regions of the printing substrate web 12 are dampened by the fluid, and thus have at least approximately the same relative moisture as the print regions 14, 16. In a particularly preferred exemplary embodiment, partial regions of the print regions 14, 16 can also be printed with fluid via the moistening unit 24. In particular, how much ink is applied to which partial regions of the print region 14, 16 is determined for this, depending on the print image. The more ink that is applied, the more moisture is introduced into this partial region of the print image 14, 16. By applying fluid to the partial regions in which relatively little ink was applied, in these partial regions of the print regions 14, 15 the moisture of the printing substrate web 12 is increased in turn so that approximately the same relative moisture within the print regions 14, 16, independent of how much ink was applied at which point of the print regions, 14, 16.

In an alternative exemplary embodiment of the invention, the fluid can also be applied with the aid of other devices instead of a print head, which devices enable a targeted application of the fluid at partial regions of the printing substrate web 12. In particular, individual nozzles via which the fluid is sprayed can be used for this.

The application of the fluid in particular takes place immediately after the application of the ink. It is thus achieved that the moisture differences of the printing substrate web 12 are compensated promptly so that fold formation is avoided.

In an additional alternative exemplary embodiment of the invention, the device 26 comprises a drying unit via which the printing substrate web 12 is dried after the printing. In this case it is advantageous if the moistening unit 24 is only arranged after the drying unit (as viewed in the transport direction P1 of the printing substrate web 12), such that the print regions 14, 16 are dried before the fluid is applied. It is hereby achieved that the print regions 14, 16 have a lower relative moisture upon application of the fluid than before the drying, such that less fluid must be applied to compensate for the moisture differences. Furthermore, the arrangement of the moistening unit 24 after the drying unit has the advantage that less energy must be applied for the drying since less moisture has been applied to the printing substrate web 24 beforehand. After the drying, the relative moisture of the printing substrate web 12 in the print regions 14, 15 is in particular between 35% and 40%, in contrast to which the relative moisture in the unprinted regions is merely between 15% and 20%.

In a further alternative exemplary embodiment of the invention, the printing substrate web 12 can be printed on both sides. For this the printing substrate web 12 is initially printed from a first side, then turned, and subsequently is printed from the second side. In this embodiment, the fluid is in particular applied between the printing of the first side and the printing of the second side, such that the curling is prevented or at least reduced before the second side is printed. The print quality of the second side is hereby improved since, by avoiding the curling, it is prevented that the applied ink droplets are applied to the printing substrate web 12 at different points in time and/or at different angles. Moreover, the contact between the printing substrate web 12 and the print heads that are provided to print to the second side is avoided, such that the service life of these print heads is increased. In particular, a plugging of nozzles and/or a scratching due to the contact between the printing substrate web 12 and the print heads is avoided.

In a further alternative exemplary embodiment of the invention, not just the partial region 28 but the entire unprinted region of the printing substrate web 12 can be dampened with the fluid, such that the entire printing substrate web 12 subsequently has approximately the same relative moisture.

Figure 5:
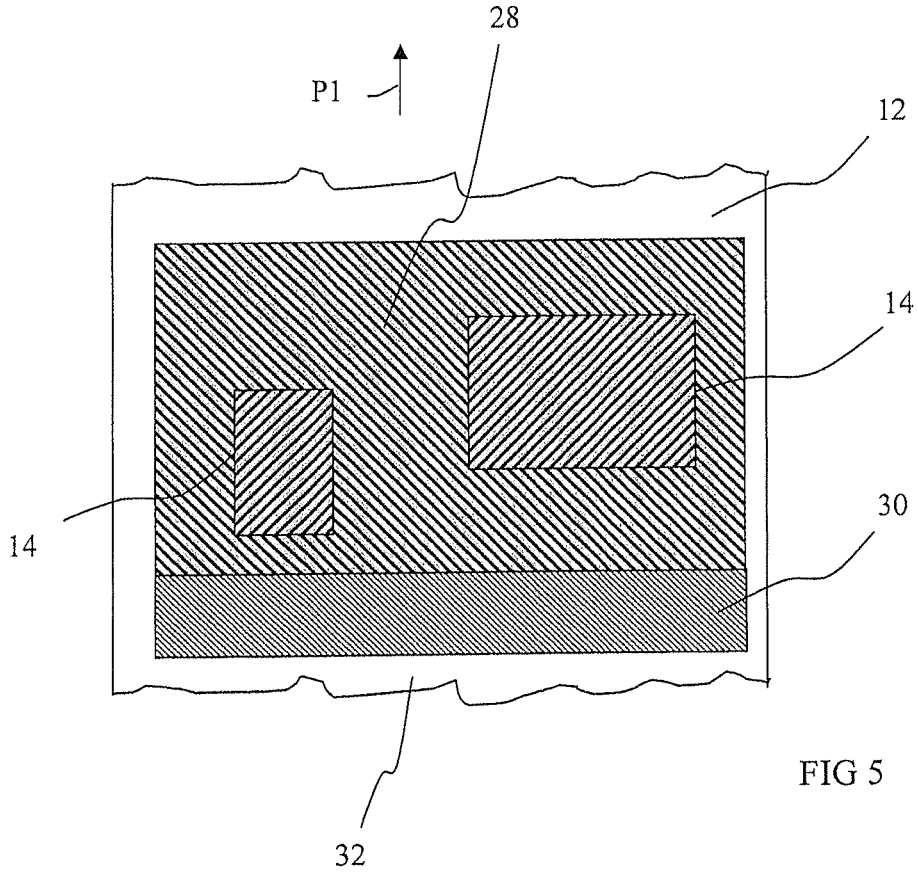
FIG. 5 is a schematic presentation of a section of a printing substrate web printed according to a method according to a second exemplary embodiment.

A schematic presentation of the printing substrate web 12 is shown in FIG. 5, wherein this has been printed according to a second exemplary embodiment of the invention. In this second embodiment of the invention, a likewise unprinted, additional partial region 30 following the unprinted partial region 28 is likewise dampened by the moistening unit 24 in that the fluid is likewise applied in the additional partial region 30. A larger quantity of fluid is applied per areal unit in the partial region 28 than in the additional partial region 30. The transition between the partial region 28 with a high relative moisture and the partial region 32 of the printing substrate web 12 at which neither ink nor fluid was applied (and that thus has a lower relative moisture) is designed in stages due to this additional partial region 30. The tension differences are herewith also reduced, and the curling is prevented or at least reduced.

In a further alternative exemplary embodiment of the invention, even more partial regions can also be moistened with different quantities of fluid. In particular, a staged transition takes place between the partial region 28 with the highest relative moisture of the printing substrate web 12 and the partial region 32 with the lowest relative moisture of the printing substrate web 12.

Figure 6:
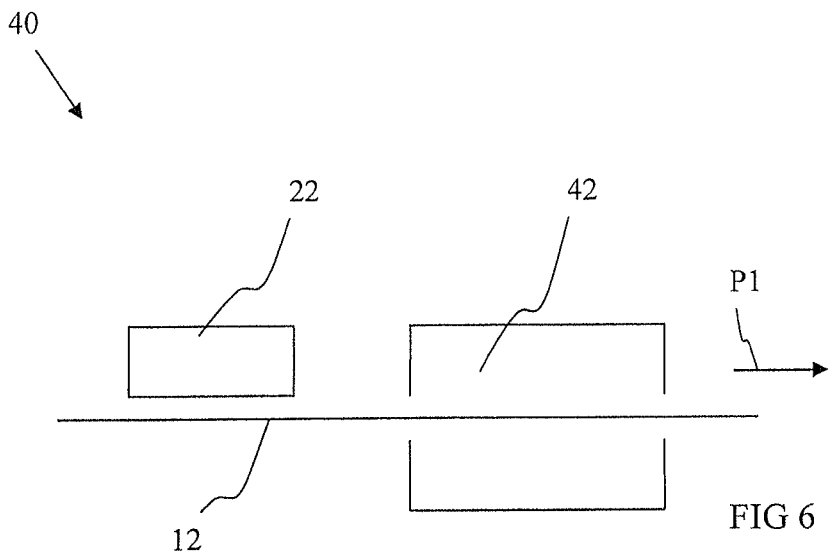
FIG. 6 is a schematic presentation of a device for printing a printing substrate web according to a third exemplary embodiment.

A schematic presentation of a device 40 to print the printing substrate web 12 with ink according to the third exemplary embodiment of the invention is shown in FIG. 6. With the aid of the print head 22, the ink is again printed onto the printing substrate web 12 transported in the transport direction P1. After the application of the ink, the printing substrate web 12 is transported through a moistening unit designed as a climate-controlled space 42. A high absolute humidity prevails in this climate-controlled space 42. The absolute humidity in the climate-controlled space 42 is in particular higher than in the region in which the print head 22 is arranged. Due to the high absolute humidity, a relatively larger vapor pressure difference exists between the printing substrate web 12 and the air surrounding the printing substrate web 12 within the climate-controlled space 42. Due to the relatively large vapor pressure difference, a compensation of the moisture differences occurs within the printing substrate web 12. In particular, the unprinted partial regions 28 of the printing substrate web 12 absorb more moisture from the environment air than the print regions 14, 16, such that the relative moisture in the unprinted partial region 28 of the printing substrate web 12 is increased. The quantity of moisture absorbed from the environment air in particular also depends on the absorption capability of the printing substrate.

Via the provision of such a climate-controlled space 42 to moisten the printing substrate web 12, it is achieved that the natural processes to equalize the moisture of the printing substrate web 12 are accelerated, and thus approximately the same relative moisture is achieved in the entire printing substrate web 12 without a large control cost. The relatively high absolute humidity in the climate-controlled space 42 is in particular achieved via the vaporization or volatilization of water-based fluid (water, for example).

In a further alternative exemplary embodiment, the moistening unit can also be designed such that it blows humidified air onto the printing substrate web 12. The printing substrate web 12 absorbs more moisture in the unprinted partial regions 18 than in the print regions 14,16, such that the moisture difference is compensated or at least reduced.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. A method to reduce curling of a printing substrate in a printer, comprising the steps of:

printing at least one print region of the printing substrate with ink;

increasing a moisture level of the printing substrate in at least one unprinted partial region of said printing substrate that is arranged on a same side of the printing substrate as the print region; and also increasing a moisture level of the printing substrate in an unprinted additional partial region adjoining the at least one partial region, the moisture level of the printing substrate being increased by applying a transparent fluid on the unprinted partial region and the additional partial region, and wherein a quantity of transparent fluid applied per area unit is less in the additional partial region than in the partial region so that the moisture level of the additional partial region is less than the moisture level of the partial region.

2. The method according to claim 1 wherein a preset quantity of the transparent fluid is applied, wherein said preset quantity is preset such that after the application of the transparent fluid, the printing substrate has approximately a same relative moisture in the print region and in the unprinted partial region at which the transparent fluid is applied.

3. The method according to claim 1 in which the printing substrate is transported through a humidifier space in which absolute humidity is higher than in a region of print heads which are used to apply the ink to the printing substrate.

4. A device to print to a printing substrate with ink, comprising:

at least one print head that prints to at least one print region of the printing substrate with ink;

a moistening unit to increase a moisture level of the printing substrate in at least one unprinted partial region of the printing substrate arranged on a same side of the printing substrate as the print region; and the moistening unit also increasing a moisture level of the printing substrate in an unprinted additional partial region adjoining the partial region, a quantity of fluid applied per area unit by the moistening unit being less in the additional partial region than in the partial region so that the moisture level of the additional partial region is less than the moisture level of the partial region.

5. The device according to claim 4 in which the moistening unit comprises at least one additional print head to apply a transparent fluid onto the at least one unprinted partial region.

6. A method to reduce curling of a printing substrate in a printer, comprising the steps of:

printing at least one print region of the printing substrate with ink;

increasing a moisture level of the printing substrate in at least one unprinted partial region of said printing substrate that is arranged on a same side of the printing substrate as the print region, said moisture level being increased by applying a transparent fluid on the unprinted partial region, and wherein a preset quantity of transparent fluid is applied, said preset quantity being preset such that after the application of the transparent fluid, the printing substrate has approximately a same level of moisture in the print region and in said unprinted partial region at which the transparent fluid is applied; and also increasing a moisture level of the printing substrate in an unprinted additional partial region adjoining the at least one partial region, the moisture level of the printing substrate being increased by applying a transparent fluid on the unprinted partial region and the additional partial region, and wherein a quantity of transparent fluid applied per area unit is less in the additional partial region than in the partial region so that the moisture level of the additional partial region is less than the moisture level of the partial region.

7. A device to print to a printing substrate with ink, comprising:

at least one print head that prints to at least one print region of the printing substrate with ink;

a moistening unit to increase a moisture level of the printing substrate in at least one unprinted partial region of the printing substrate arranged on a same side of the printing substrate as the print region, said moistening unit comprising at least one additional print head to apply a transparent fluid onto the at least one unprinted partial region, and wherein a preset quantity of the transparent fluid is applied, said preset quantity being preset such that after the application of the transparent fluid, the printing substrate has approximately a same relative moisture in the print region and in the unprinted partial region at which the transparent fluid is applied; and the moistening unit also increasing a moisture level of the printing substrate in an unprinted additional partial region adjoining the partial region, a quantity of fluid applied per area unit by the moistening unit being less in the additional partial region than in the partial region so that the moisture level of the additional partial region is less than the moisture level of the partial region.

* * * * *